United States Patent [19]

Leung et al.

[11] Patent Number: 4,994,706

[45] Date of Patent: Feb. 19, 1991

[54] FIELD FREE, DIRECTLY HEATED LANTHANUM BORIDE CATHODE

[75] Inventors: Ka-Ngo Leung, Hercules; David Moussa, San Francisco; Stephen B. Wilde, Pleasant Hill, all of Calif.

[73] Assignee: The United States of America as represented by the United States Department of Energy, Washington, D.C.

[21] Appl. No.: 10,053

[22] Filed: Feb. 2, 1987

[51] Int. Cl.[5] ..... H01J 1/15; H01J 1/92

[52] U.S. Cl. ..... 313/30; 313/39; 313/231.01; 313/346 R

[58] Field of Search ..... 313/336, 346 R, 362.1, 313/339, 231.01, 231.31, 30, 39; 315/111.21, 111.41, 111.81; 250/426

[56] References Cited

U.S. PATENT DOCUMENTS

| | | | |
|---|---|---|---|
| 4,140,943 | 2/1979 | Ehlers | 315/111 |
| 4,258,283 | 3/1981 | Brünger et al. | 313/336 |
| 4,297,615 | 10/1981 | Goebel et al. | 315/111.81 |
| 4,339,691 | 7/1982 | Morimiya et al. | 315/111.21 |
| 4,429,250 | 1/1984 | Clerc et al. | 313/336 |
| 4,442,383 | 4/1984 | Hill | 315/349 |
| 4,486,684 | 12/1984 | Hohn | 313/336 |
| 4,542,321 | 9/1985 | Singh et al. | 315/111.81 |
| 4,634,921 | 1/1987 | Williams et al. | 313/342 |

OTHER PUBLICATIONS

Rev. Sci. Instrum., 50(11), Nov. 1979, Ehlers et al, "Characteristics of the Berkeley multicusp ion source".

Rev. Sci. Instrum. 55(7), Jul. 1984, Leung et al, "Directly heated lanthanum hexaboride filaments".

Rev. Sci Instrum. 56(5), May 1985, Pincosy et al., "Lanthanum hexaboride tapered filament in a plasma source".

Rev. Sci. Instrum. 56(9), Sep. 1985, Goebel et al, "Large-area lanthanum hexaboride electron emitter".

*Primary Examiner*—Kenneth Wieder

*Attorney, Agent, or Firm*—L. E. Carnahan; Roger S. Gaither; William R. Moser

[57] ABSTRACT

A directly heated cylindrical lanthanum boride cathode assembly is disclosed which minimizes generation of magnetic fields which would interfere with electron emission from the cathode. The cathode assembly comprises a lanthanum boride cylinder in electrical contact at one end with a central support shaft which functions as one electrode to carry current to the lanthanum boride cylinder and in electrical contact, at its opposite end with a second electrode which is coaxially position around the central support shaft so that magnetic fields generated by heater current flowing in one direction through the central support shaft are cancelled by an opposite magnetic field generated by current flowing through the lanthanum boride cylinder and the coaxial electrode in a direction opposite to the current flow in the central shaft.

4 Claims, 3 Drawing Sheets

FIELD FREE, DIRECTLY HEATED LANTHANUM BORIDE CATHODE

BACKGROUND OF THE INVENTION

The invention described herein arose in the course of, or under, Contract No. DE-AC03-76SF00098 between the United States Department of Energy and the University of California.

The invention relates to cathodes for electron discharge devices and more particularly to a field free, directly heated lanthanum boride cathode useful in a device having positive ion flow.

Ehlers et al, in an article entitled "Characteristics of the Berkeley Multicusp Ion Source", Rev. Sci. Instrum. 50 (11), November 1979, at pp. 1353–1361, discuss the short lifetimes of tungsten filaments operated with a long pulse duration and suggest the use of lanthanum hexaboride or impregnated oxide cathodes instead. The impregnated oxide cathode is described as a cylindrical cathode mounted on a molybdenum holder and heated internally by a noninductive tungsten filament.

The use of lanthanum boride as a cathode material is attractive because of its high melting point, chemical inertness, low work function, and resistance to erosion under ion bombardment When heated to a temperature of 1600° K. or higher, lanthanum boride is a copious emitter of electrons.

Leung et al, in an article entitled "Directly Heated Lanthanum Hexaboride Filaments", published in Rev. Sci. Instrum. 55 (7), July 1984, at pp. 1064–1068, describes physical properties of lanthanum hexaboride filaments, when operated as cathodes in a gas discharge. The use of a hairpin like configuration for the lanthanum hexaboride filament is described to compensate for thermal expansion of the material.

Pincosy et al, in "Lanthanum Hexaboride Tapered Filament in a Plasma Source", Rev. Sci. Instrum. 56 (5), May 1985, at pp. 655–658, discuss results obtained using a lanthanum hexaboride filament in a plasma source wherein the width of the filament is tapered to obtain a more uniform temperature distribution along the filament to provide a uniform electron emission along the entire length of the filament.

Goebel et al in "Large-Area Lanthanum Hexaboride Electron Emitter", Rev. Sci. Instrum. 56 (9), September 1985, at pp. 1717–1722, discuss the characteristics of lanthanum-boron thermionic emitters and describe a large-area, indirectly heated, continuously operated lanthanum boride cathode assembly and the tungsten filament heater used to indirectly heat the lanthanum boride.

The use of lanthanum hexaboride material as a cathode for thermionic emission of electrons is also described in Brunger et al U.S. Pat. Nos. 4,258,283 and Clerc 4,429,250. Goebel et al. 4,297,615 describes the use of a lanthanum hexaboride cylindrical cathode in a plasma generating device. The lanthanum hexaboride cathode is indirectly heated by a non-inductive tungsten heater supported in the cathode cylinder by support rods.

Morimiya et al U.S. Pat. No. 4,339,691 discloses a discharge apparatus containing a hollow cylindrical cathode made from a refractory metal and coated on the inside with an electron emitter such as lanthanum hexaboride. A heater is placed within the cylindrical cathode which is insulated from the cathode. The hollow cathode is initially heated by the heater after which a source of ionizing gas is fed into the hollow cathode and a discharge arc is ignited between the heater and the cathode. Plasma obtained within the hollow cathode is said to drift through an opening in the cathode toward the anode within the discharge apparatus to establish an arc between the cathode and the anode. In another embodiment, the heater is replaced by a disk electrode located within the hollow cathode which is made more positive than the cathode to cause the cathode to emit electrons. Hydrogen gas is then admitted to the hollow cathode and a plasma is established between the disk electrode and the cathode which causes both to be heated by ion bombardment. This plasma then drifts toward the anode and sets up an arc between the cathode and the anode as before.

When a cathode used in a plasma generating device is directly heated to emit electrons, nonuniform emission of electrons from the cathode can result from nonuniform temperature distribution along the cathode unless the cathode is specially shaped to provide the necessary uniform temperature distribution.

Even if such uniform temperature is achieved through the use of a specially designed directly heated cathode, the magnetic fields generated by the current flowing through the cathode to heat it can be strong enough to interfere with electron emission from the cathode when the discharge voltage is low, i.e., less than about 70 volts.

It would, therefore, be desirable to have a directly heated lanthanum boride cathode in which the magnetic field generated by the heater current would be minimized.

SUMMARY OF THE INVENTION

It is, therefore, an object of this invention to provide a directly heated lanthanum boride cathode assembly for use in a plasma generating apparatus which minimizes magnetic field generation by heater current.

It is another object of this invention to provide a directly heated lanthanum boride cathode assembly for use in a plasma generating apparatus which minimizes heater current magnetic field generation by using a coaxial cathode structure to cancel the magnetic field generated by the heater current.

It is yet another object of this invention to provide a directly heated lanthanum boride cathode assembly for use in a plasma generating apparatus which can be operated with minimum heater current by maintaining the cathode heat principally by ion bombardment whereby magnetic field generation by heater current is minimized.

These and other objects of the invention will be apparent from the following description and accompanying drawings.

In accordance with the invention, a directly heated cylindrical lanthanum boride cathode assembly comprises a lanthanum boride cylinder in electrical contact at one end with a central support shaft which functions as one electrode to carry current to the lanthanum boride cylinder and in electrical contact, at its opposite end with a second electrode which is coaxially position around the central support shaft so that magnetic fields generated by heater current flowing in one direction through the central support shaft are cancelled by an opposite magnetic field generated by current flowing through the lanthanum boride cylinder and the coaxial electrode in a direction opposite to the current flow in the central shaft.

DETAILED DESCRIPTION OF THE INVENTION

Figure 1:
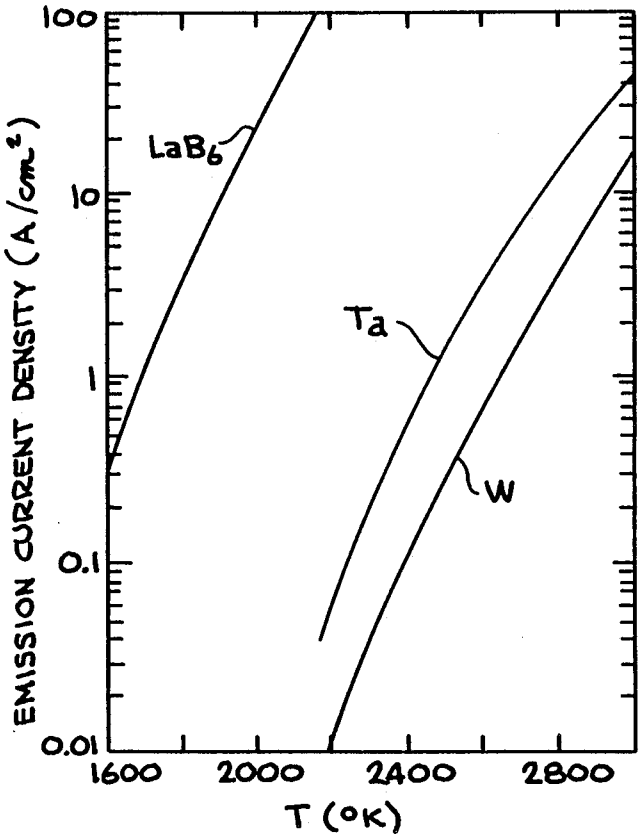
FIG. 1 is a graph plotting the calculated emission current density as a function of temperature for lanthanum hexaboride, tantalum, and tungsten cathodes.

FIG. 1 shows the advantages of using a lanthanum boride cathode over conventional tantalum and tungsten cathodes. It can be seen that a current density of 10 $A/cm_2$ can be easily obtained from a lanthanum boride cathode heated to a temperature of 1900° K.

Thus, if the electron emission-suppressing effects of a magnetic field generated by a directly heated cathode can be eliminated or mitigated, the use of a lanthanum boride cathode in plasma generating apparatus should result in rapid start up as well as the possibility of operating with little or no heater current flowing during actual operation in view of the high current flow at a given temperature in contrast to other cathode materials.

Figure 2:
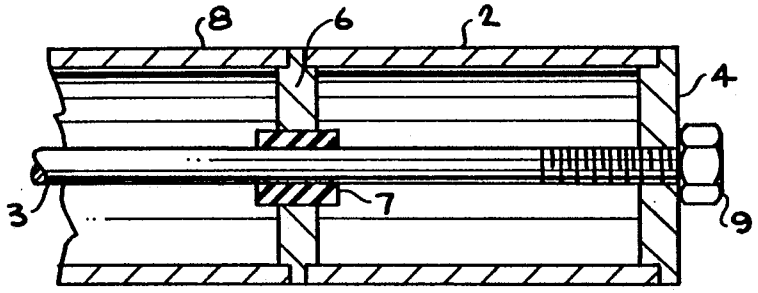
FIG. 2 is a cross-section of a simplified version of a portion of the cathode assembly of the invention.

Referring now to FIG. 2, the cathode assembly of the invention is depicted in a simplified form for illustrative purposes only. A cylindrical lanthanum boride cathode 2 has a central support shaft 3 passing therethrough comprising a first electrode which provides electrical contact to one end of cathode 2 through washer member 4 which comprises a conductive material, such as rhenium, which is reasonably nonreactive with lanthanum boride at high temperatures. Central support shaft 3 is secured to washer 4 by securement means 9 which may comprise a nut received on a threaded portion of shaft 3 as will be explained in more depth in the description of FIGS. 3 and 4. A similar washer 6 is secured to the opposite end of lanthanum boride cylinder 2 and a hollow cylindrical electrode 8 comprising a second electrode is electrically and mechanically secured to washer 6 to provide electrical contact to the opposite end of the lanthanum cathode 2. Insulator sleeve 7 permits the passage of central shaft 3 through washer 6.

As will be readily apparent from this simplified view, current flowing through central shaft 3 to the one end of lanthanum boride cathode 2 will generate a magnetic field flowing around shaft 3 in one direction. However, this current will then flow in the opposite direction down the cylindrical lanthanum boride cathode and the sleeve electrode 8 coaxial with the current flow in central shaft 3. Thus the magnetic field generated by the current flow along cathode 2 and sleeve electrode 8 will oppose and at least partially cancel the first magnetic field generated by the current flow through shaft 3. Suppression of emission of electrons from the surface of the heated lanthanum boride cathode by the generated magnetic fields of the heater current should be either eliminated or substantially reduced by this design when the cathode assembly is positioned inside apparatus suitable for initiation of electron and ion flow.

It should be noted that the term "lanthanum boride" is used herein to refer to the cathode material initially made from $LaB_6$ and which is commonly referred to in the art as lanthanum hexaboride. It has been noted that the lanthanum boride cathode, when initially constructed from $LaB_6$, changes in color after several hours of use from the characteristic purple of $LaB_6$ to a grayish color characteristic of $LaB_4+LaB_6$, indicating a decrease in the B/La ratio. However, since $LaB_4$ has an even lower work function, electron emission should be enhanced by this. Thus the term "lanthanum boride", as used herein, is intended to embrace not only $LaB_6$, but other lanthanum borides as well which may be formed during operation of a cathode formed initially from $LaB_6$.

Figure 3:
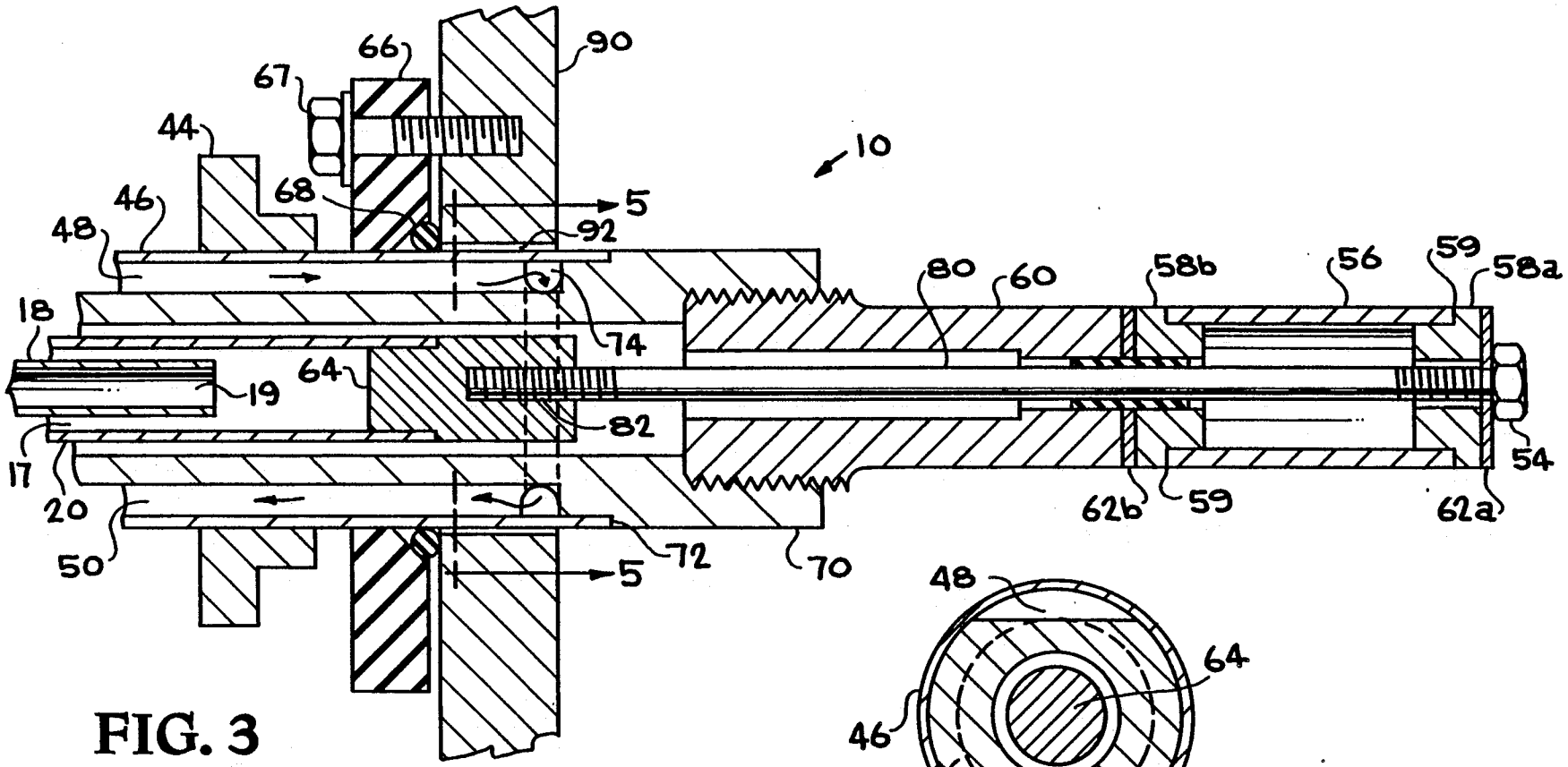
FIG. 3 is a vertical cross section view of a first fragmentary portion of the cathode assembly of the invention.
Figure 4:
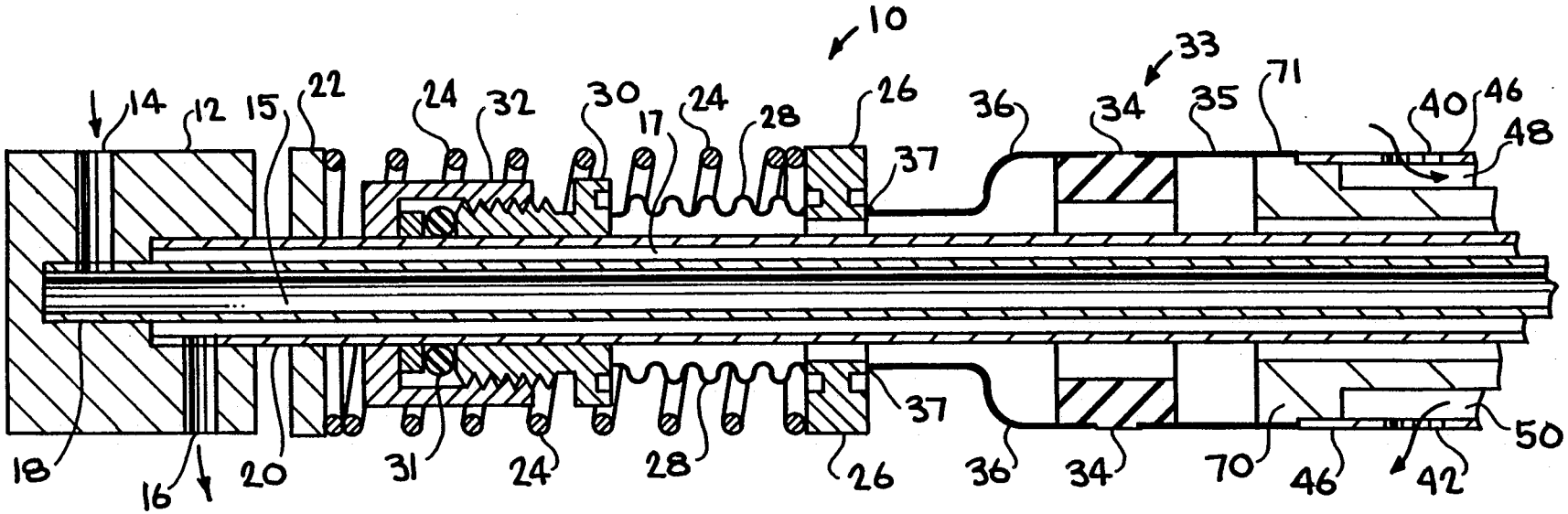
FIG. 4 is a vertical cross section view of a second fragmentary portion of the cathode assembly shown in FIG. 3 which has been broken into two fragments in the interest of clarity of the invention.

Turning now to FIGS. 3 and 4, a cathode assembly 10 constructed in accordance with the best mode of practicing the invention is shown. A thin wall lanthanum boride cylinder 56, which may comprise a thin hollow cylinder of 0.8 millimeters (mm) wall thickness, 11 mm in diameter, and 35 mm long, is joined at both ends to lanthanum boride caps or collars 58*a* and 58*b* having the same O.D. and formed with a thin shoulder 59 to receive cylinder 56 to make a smooth assembly.

Washers 62*a* and 62*b*, formed of a material compatible with lanthanum boride at high temperatures, are respectively placed over the exposed sides of cap 58*a* and cap 58*b* and are secured together with caps 58*a* and 58*b* and cylinder 56 as an assembly by nipple 60 and nut 54 as will be described below. Washers 62*a* and 62*b* may comprise rhenium foil, graphite, or carburized tantalum and prevent reaction between adjoining refractory metals and the lanthanum boride.

Washer 62*b*, which fits against cap 58*b*, is secured by brazing to a nipple 60 constructed of tantalum or molybdenum metal to withstand the high temperature attained by the lanthanum boride during emission. Nipple 60 is, in turn, threaded into a copper sleeve 70 which is silver soldered to a copper tube 46. Nipple 60, sleeve 70, and copper tube 46 comprise the outer electrode through which current will pass to the lanthanum boride cathode via cap 58*b*. A collar 44, which may be either clamped or soldered to tube 46 depending upon the desired flexibility of adjustment of the length of the assembly, may be connected to one terminal of a power supply (not shown) used to initially heat the cathode.

Cathode assembly 10 is secured in vacuum tight fit to the side wall 90 of a vacuum chamber such as a plasma generating apparatus having an opening 92 through which the inner portion of cathode assembly 10 containing the lanthanum boride cathode may be inserted. An insulating washer 66, having a chamfered inner edge to receive an O-ring seal 68, is fitted around tube 46 (and sleeve 70) and secured to wall 90 by bolts 67 which compress O-ring seal 68 tightly to provide the desired vacuum seal.

Figure 5:
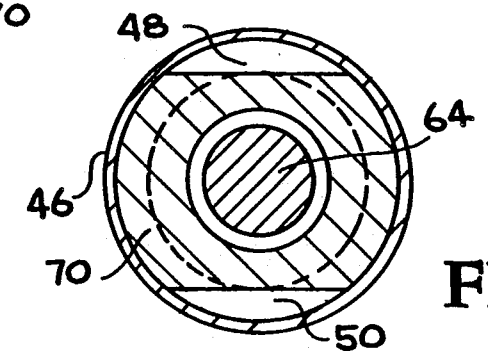
FIG. 5 is an end view in section of a portion of FIG. 3 taken 5—5.

Sleeve 70 is formed with a shoulder 72 which receives tube 46 to form a smooth fit of common diameter. Sleeve 70 as shown in FIG. 3, is further formed with an annular groove 74 and, as best seen in FIG. 5, two flat portions which extend along most of the length of sleeve 70 to form, in cooperation with tube 46, passageways 48 and 50 which both are in communication with annular groove 74.

Passageways 48 and 50, together with annular groove 74, comprise cooling means through which a coolant such as water may be used to protect sleeve 70 and tube 46 from the operating temperatures of the cathode assembly thus permitting construction materials such as copper and silver soldering to be used. Water, entering into passageway 48 through an opening 40 in tube 46, flows down passageway 48 to annular groove 74 and then back down passageway 50 and out through a second port 42 in tube 46.

An insulator assembly 33 may be brazed to sleeve 70 at 71 to electrically isolate sleeve 70, tube 46, and nipple 60 from the remainder of cathode assembly 10. Insulator assembly 33 comprises a cylindrical ceramic insulator 34 which may have a first thinwall stainless steel sleeve 35 brazed to one end thereof which, in turn, may be brazed or soldered to sleeve 70 at 71. A second thinwall stainless steel sleeve 36, in turn, may be silver soldered at 37 to a flange 26.

The composite central electrode of cathode assembly 10 which makes electrical contact with cap **58*a*** at the opposite end of the lanthanum boride cathode will now be described.

Mounted into a coolant water manifold block 12 is a hollow copper rod 20 having a copper end piece 64 brazed to its opposite end and a split ring collar 22 secured around tube 20 to provide a contact to a power supply used to heat the cathode. End piece 64 has a threaded central bore 82 which receives a shaft 80 formed from tantalum or other refractory metal of good conductivity capable of withstanding the operating temperatures of cathode assembly 10. The opposite end of shaft 80 is also threaded and a nut 54, conveniently made from molybdenum or similar metal, is fastened thereon against washer **62*a* and lanthanum boride collar 58*a*** to provide electrical contact thereto. Thus the two electrode assemblies connected respectively to the opposite ends of the cylindrical lanthanum boride cathode are mounted coaxial to one another.

To provide cooling for the portions of the central electrode made from materials not designed to withstand the operating temperature of the lanthanum boride cathode, such as copper tube 20, a squirt tube 18 is mounted within tube 20 and connected to manifold block 12 so that coolant may enter squirt tube 18 via inlet port 14 and pass down central passage 15 in tube 18 to exit at the end 19 where it then passes back through tube 20 in passage 17 defined by the outer wall of squirt tube 18 and the inner wall of tube 20 to exit through port 16 in manifold block 12.

To provide an electrically secure connection between the center electrode and the cathode collar **58*a* and washer 62*a* via nut 54** which will, at the same time, compensate for thermal expansion, the center electrode is placed in tension against the cathode by a spring loading mechanism.

A spring 24 has one end thereof placed against split ring 22 and the opposite end against flange 26 in which tube 20 fits snugly. When the outer electrode is secured to the wall of the plasma apparatus, spring 24, in compression will urge split ring 22 away from flange 26. This creates the desired yieldable bias against collar **58*a* and washer 62*a* to achieve a good electrical connection thereto without risking damage to the lanthanum boride members through thermal expansion which, rather, will merely put further tension on spring 24**.

A vacuum tight seal may be formed around tube 20 by gland nut 32 and fitting 30 which will compress O-ring 31 therebetween against the outer wall of tube 20. Fitting 30, in turn, may be soldered to a flexible metal bellows 28 which may be similarly soldered, at its opposite end, to flange 26.

In operation then, heater current initially passes through the coaxial electrode assembly to both ends of the lanthanum boride cathode through which it flows to heat the cathode causing it to emit electrons which, in turn, ionize gas such as helium, argon, or hydrogen within the plasma chamber causing the establishment of an ion plasma flow between a positive electrode in the plasma chamber and the hot lanthanum boride cathode. The resulting ion bombardment of the lanthanum boride results in sufficient generation of heat to sustain the electron emission even when the heater current is reduced or, in cases when the discharge current exceeds 25 amps, turned off completely. The magnetic fields, generated during heater current flow, cancel one another out due to the coaxial disposition of the respective electrodes connecting the lanthanum boride cathode to the power supply thus permitting electron emission even at very low discharge voltages. At higher discharge voltages, i.e., over 70 volts, a discharge current greater than 100 amps has been obtained from a single cathode assembly constructed in accordance with the invention and used in a steady state plasma source operation.

A cathode assembly, constructed in accordance with the invention, was tested in a 20 cm diameter by 20 cm long multicusp plasma generator operated with hydrogen gas at a pressure of about $1\times10^{-3}$ Torr. The cathode was installed inside the field free region of the source chamber. The negative terminals of the heater and the discharge power supplies were both connected to the center conductor of the cathode assembly. Only the positive terminal of the heater power supply was connected to the outer connector, with the positive terminal of the discharge power supply connected to the positive electrode in the source chamber.

In order to raise the cathode temperature to 1600° K., a heater current of approximately 130 amps was needed. Because of the coaxial construction, the magnetic field associated with the heater current flowing up the tantalum rod tended to cancel out the field generated by the same heater current flowing down the cathode cylinder. On the other hand, the magnetic field generated by the discharge current flowing up the tantalum rod was not completely cancelled because the discharge current gradually decreases as it flows down the outer cylinder. However, this magnetic field is much smaller compared to that generated on a filament surface due to the much larger cathode radius. With the cathode assembly of the invention, it was possible to emit electrons with energies as low as 1 or 2 eV continuously into a background hydrogen plasma.

In order to initiate a discharge in an ion source, electrons with energies in the order of 70 eV are needed to ionize the background gas. In this case, a dc power supply equipped with a current limiting mode is required for the discharge operation. The discharge is first set at a value of about 100 volts. A heating power of about 3 volts and 130 amps is then used to bring the lanthanum boride to the emission temperature. Once the discharge is established, the heater current can be reduced gradually with the increase of the discharge current. When the discharge current exceeds 25 amps, the heater supply can be switched off altogether. The ion source may then operated with only one power supply.

Figure 6:
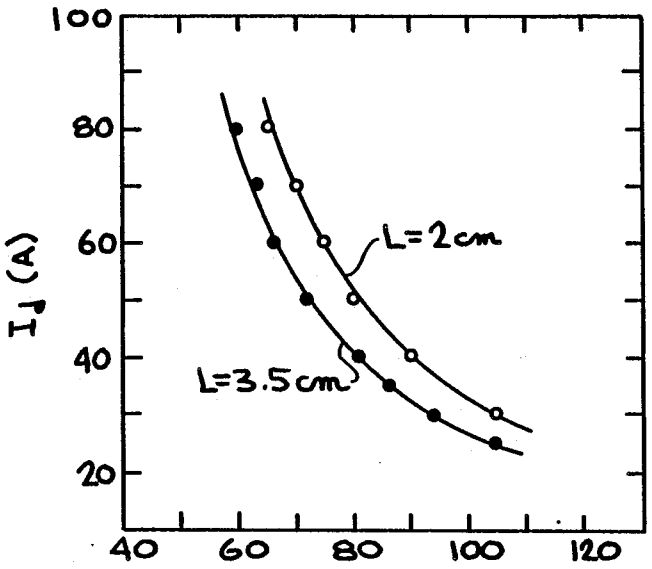
FIG. 6 is a graph plotting discharge voltage versus discharge current for the cathode once a discharge in an ion source has been initiated.

A plot of the discharge current versus the discharge voltage in the absence of a heater current is shown in FIG. 6. As the discharge current $I_d$ is increased from 25 to 80 amps, the discharge voltage $V_d$ is reduced automatically from 105 to 60 volts. Optical pyrometer measurement of the cathode indicated that the average temperature on the cathode surface was about 1830° K. With this temperature, the graph in FIG. 1 shows that the lanthanum boride cathode should be able to provide an emission current density of 6 amps/cm$^2$ or a total emission current of 78 amps for a cathode area of 13 cm$^2$. This result is in good agreement with the observed discharge current of 80 amps after the positive ion current of about 2.6 amps collected by the cathode is subtracted off. A discharge current as high as 100 amps (limited by the power supply) has been obtained from this cathode. By operating the lanthanum boride cathode at a temperature of 2000° K, the cathode should be able to provide an emission current exceeding 200 amps.

While a specific embodiment of the improved cathode assembly of the invention has been illustrated and described in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A directly heated cylindrical lanthanum boride cathode assembly characterized by minimum generation of electron emission-inhibiting magnetic fields comprising:

(a) a lanthanum boride cylindrical cathode comprising a central cylindrical portion and end caps secured to a first end and an opposite end of said central cylindrical portion;

(b) a central support shaft coaxially passing through said central cylindrical portion of said lanthanum boride cathode and through central openings in said lanthanum boride end caps, said central shaft comprising a first electrode in electrical communication with said lanthanum boride end cap secured to said first end of said central cylindrical portion of said lanthanum boride cathode, to carry current flowing through said lanthanum boride cylinder;

(c) a hollow cylindrical second electrode coaxially positioned around said central support shaft and in electrical communication at one end thereof with the lanthanum boride end cap on the opposite end of said central cylindrical portion of said lanthanum boride cathode to carry current flowing through said lanthanum boride cathode cylinder;

(d) first and second washer means respectively positioned between said lanthanum boride end caps and said electrodes and constructed of nonreactive conductive material selected from the class consisting of rhenium, graphite, and carburized tantalum;

(e) means for securing said second electrode to said lanthanum boride end cap at said opposite end of said central cylindrical portion of said lanthanum boride cathode through said first washer means;

(f) threaded means on said central shaft to secure said shaft to the end cap at said first end of said lanthanum boride central cylindrical portion through said second washer means;

(g) cooling means comprising one or more cooling passageways between said first and second electrodes for cooling at least a portion of said electrodes; and (h) bias means between said first and second electrodes to urge said electrodes respectively against the lanthanum boride end caps at the opposite ends of said lanthanum boride cathode to thereby provide an electrically secure connection between said lanthanum boride cathode and said electrodes which will compensate for thermal expansion during operation;

whereby magnetic fields generated by heater current flowing in one direction through said central support shaft are cancelled by an opposite magnetic field generated by current flowing through said lanthanum boride cylindrical cathode and said second coaxial electrode in a direction opposite to the current flow in said central shaft comprising said first electrode.

2. The cathode assembly of claim 1 wherein at least portions of said coaxially positioned first and second electrodes not cooled by said cooling means are constructed of refractory metals to withstand the temperatures generated by said lanthanum boride cathode.

3. A directly heated cylindrical lanthanum boride cathode assembly characterized by minimum generation of electron emission-inhibiting magnetic fields comprising:

(a) a lanthanum boride cylindrical cathode comprising a hollow cylinder and first and second end caps respectively positioned at each end of said cylinder, each of said end caps having a central opening therein;

(b) a central support shaft coaxially passing through said lanthanum boride cathode and in electrical contact adjacent one end thereof with said first lanthanum boride end cap, said central support shaft comprising a first electrode to carry current flowing through said lanthanum boride cathode;

(c) a second electrode comprising a cylindrical member also coaxially positioned around said central support shaft and in electrical contact with said second end cap of said lanthanum boride cathode to carry current flowing through said lanthanum boride cylindrical cathode from said first electrode; and (d) spring means for respectively biasing said first and second electrodes against said first and second end caps of said lanthanum boride cathode to achieve a good electrical connection thereto without risking damage to said lanthanum boride cathode through thermal expansion during operation of said cathode assembly; whereby magnetic fields generated by heater current flowing in one direction through said central support shaft comprising said first electrode are cancelled by an opposite magnetic field generated by current flowing through said lanthanum boride cylindrical cathode and said cylindrical second electrode in a direction opposite to the current flow in said central shaft.

4. The directly heated cylindrical lanthanum boride cathode assembly of claim 3 which further includes means for circulating coolant between said first and second electrodes.

* * * * *